US010457542B2

(12) United States Patent
Barea et al.

(10) Patent No.: US 10,457,542 B2
(45) Date of Patent: Oct. 29, 2019

(54) SAFETY STIRRUP FOR HORSEBACK RIDING

(71) Applicant: TENUTA MONTEMAGNO HORSES S.R.L., Milan (IT)

(72) Inventors: Tiziano Barea, Milan (IT); Vanessa Maria Barea, Milan (IT)

(73) Assignee: TENUTA MONTEMAGNO HORSES S.R.L., Milan (IT)

( * ) Notice: Subject to any disclaimer, the term of this patent is extended or adjusted under 35 U.S.C. 154(b) by 328 days.

(21) Appl. No.: 15/607,503

(22) Filed: May 28, 2017

(65) Prior Publication Data

US 2017/0341925 A1 Nov. 30, 2017

(30) Foreign Application Priority Data

May 27, 2016 (IT) ..... 102016000055090

(51) Int. Cl.
*B68C 3/02* (2006.01)
*B68C 3/00* (2006.01)

(52) U.S. Cl.
CPC ..... *B68C 3/02* (2013.01); *B68C 3/00* (2013.01); *B68C 2003/0041* (2013.01); *B68C 2003/0066* (2013.01); *B68C 2003/0083* (2013.01)

(58) Field of Classification Search
CPC ..... B68C 3/02; B68C 3/00; B68C 2003/0041
See application file for complete search history.

(56) References Cited

U.S. PATENT DOCUMENTS

| | | | | |
|---|---|---|---|---|
| 475,127 | A * | 5/1892 | De Lotbinnere | |
| 6,282,872 | B1 * | 9/2001 | Schulte | B68C 3/02 54/49 |
| 6,898,924 | B1 * | 5/2005 | McCoy | B68C 3/02 54/49 |
| 2003/0051448 | A1 * | 3/2003 | Johnson | B68C 3/02 54/48 |

(Continued)

FOREIGN PATENT DOCUMENTS

| | | | |
|---|---|---|---|
| DE | 10043878 | A1 | 4/2002 |
| FR | 2873674 | A1 | 2/2006 |

(Continued)

OTHER PUBLICATIONS

Italian Search Report dated Jan. 27, 2017 in IT UA20163878.

*Primary Examiner* — Monica L Williams
(74) *Attorney, Agent, or Firm* — Henry J. Cittone; Cittone Demers & Ameri LLP

(57) ABSTRACT

A safety stirrup for horseback riding having a first semi-arch element having a first end integrally connected to a first portion of a base element of the stirrup and a second end comprising a through hole for mounting a stirrup leather; a second semi-arch element having an end elastically connected to a second portion of the base element opposed to the first portion is provided. The second semi-arch element is configured to delimit a portion for inserting a rider's foot into the stirrup. The stirrup may have an elastic interposed between the end of the second semi-arch element and the second portion of the base element. Such elastic has an extension direction parallel to a main axis of the base element allowing the second semi-arch element to bend along the main axis away from the first semi-arch element and to elastically return said second semi-arch element to a rest position.

12 Claims, 5 Drawing Sheets

(56) References Cited

U.S. PATENT DOCUMENTS

| | | | | |
|---|---|---|---|---|
| 2005/0229552 | A1* | 10/2005 | Dubourg | B68C 3/0016 54/49 |
| 2008/0104934 | A1* | 5/2008 | Morin | B68C 3/0016 54/49 |
| 2009/0266039 | A1* | 10/2009 | Gottlieb | B68C 3/02 54/47 |

FOREIGN PATENT DOCUMENTS

| | | | |
|---|---|---|---|
| FR | 2881127 | A1 | 7/2006 |
| FR | 2964961 | A1 | 3/2012 |

* cited by examiner

SAFETY STIRRUP FOR HORSEBACK RIDING

CROSS-REFERENCE TO RELATED APPLICATIONS

This application claims priority to Italian Patent Application No. 102016000055090, filed May 27, 2016, the disclosure of which is hereby incorporated by reference in its entirety.

FIELD OF APPLICATION

The present invention relates to a stirrup for horseback riding disciplines. In particular, the invention relates to an enhanced safety stirrup for horseback riding comprising safety elements adaptable to different needs or use conditions of the rider.

PRIOR ART

In order to perform horseback riding activities under safety conditions, stirrups are known and widely used, which aim at easing the insertion of the rider's foot into the arch of the stirrup and the holding in position of the foot on the platform or tread, while being configured to prevent the foot from engaging into the stirrup as a result of inadequate movements, or worse, as a result of falling.

In particular, a known type of stirrup for horseback riding comprises a stirrup arch including a first rigid semi-arch and a second flexible semi-arch separate from each other. The first semi-arch has a first end integrally connected to the tread of the base of the stirrup and a second end connected to the stirrup leather. The second flexible semi-arch is connected to a base tread portion opposed to the connection portion of the first semi-arch and is configured to bend in a direction opposite to the first semi-arch, i.e. towards the outside of the stirrup, as a result of the application of a force by the rider's foot, for example when falling, to set it free.

However, such a known safety stirrup for horseback riding does not provide any suggestions on how to improve the comfort of the rider during the performance of the horseback riding activity.

Furthermore, it does not suggest how to improve the grip of the rider's foot to the tread, and therefore the safety during the horseback riding activity, so as to adapt to the physical and sporting needs of different riders.

Furthermore, the known safety stirrup, in which the second semi-arch is bendable only towards the outside of the stirrup, does not completely eliminate the risk that, in the event of falling, the rider's foot may remain engaged to the first rigid semi-arch.

SUMMARY OF THE INVENTION

It is the object of the present invention to devise and provide a safety stirrup for horseback riding, which allows to at least partially overcome the above-mentioned limits in relation to the known stirrups.

In particular, it is an important object of the invention to provide a safety stirrup configured to allow an easier disengagement of the rider's foot in the event of falling than known stirrups.

Such an object is achieved by means of a safety stirrup for horseback riding in accordance with claim 1.

In particular, the safety stirrup for horseback riding comprises:

a first semi-arch element having a first end integrally connected to a first portion of a base element of the stirrup and a second end comprising a through hole for mounting a stirrup leather;

a second semi-arch element having an end elastically connected to a second portion of the base element opposed to the first portion, said second semi-arch element being configured to delimit, with said first semi-arch element and said base element, a portion for inserting a rider's foot in the stirrup;

such a safety stirrup is characterized in that it further comprises first elastic means interposed between the end of the second semi-arch element and the second portion of the base element, said first elastic means having an extension direction parallel to a main axis of the base element to allow the bending of the second semi-arch element along such a main axis away from the first semi-arch element as a result of the application of a force on the second semi-arch element in such a moving away direction and to elastically return said second semi-arch element to a rest position when such a force ends.

Moreover, it is an object of the invention to provide a safety stirrup for horseback riding which increases the comfort of the rider when performing the horseback riding activity.

Preferred embodiments of such a safety stirrup for horseback riding are described in the dependent claims.

BRIEF DESCRIPTION OF THE DRAWINGS

Further features and advantages of the stirrup for horseback riding according to the invention will become apparent from the following description of preferred embodiments, given by way of indicative and non-limiting example, with reference to the accompanying drawings, in which.

In the aforesaid figures, the same or similar elements are indicated by means of the same reference numerals.

DETAILED DESCRIPTION OF THE PREFERRED EMBODIMENTS

Figure 1:
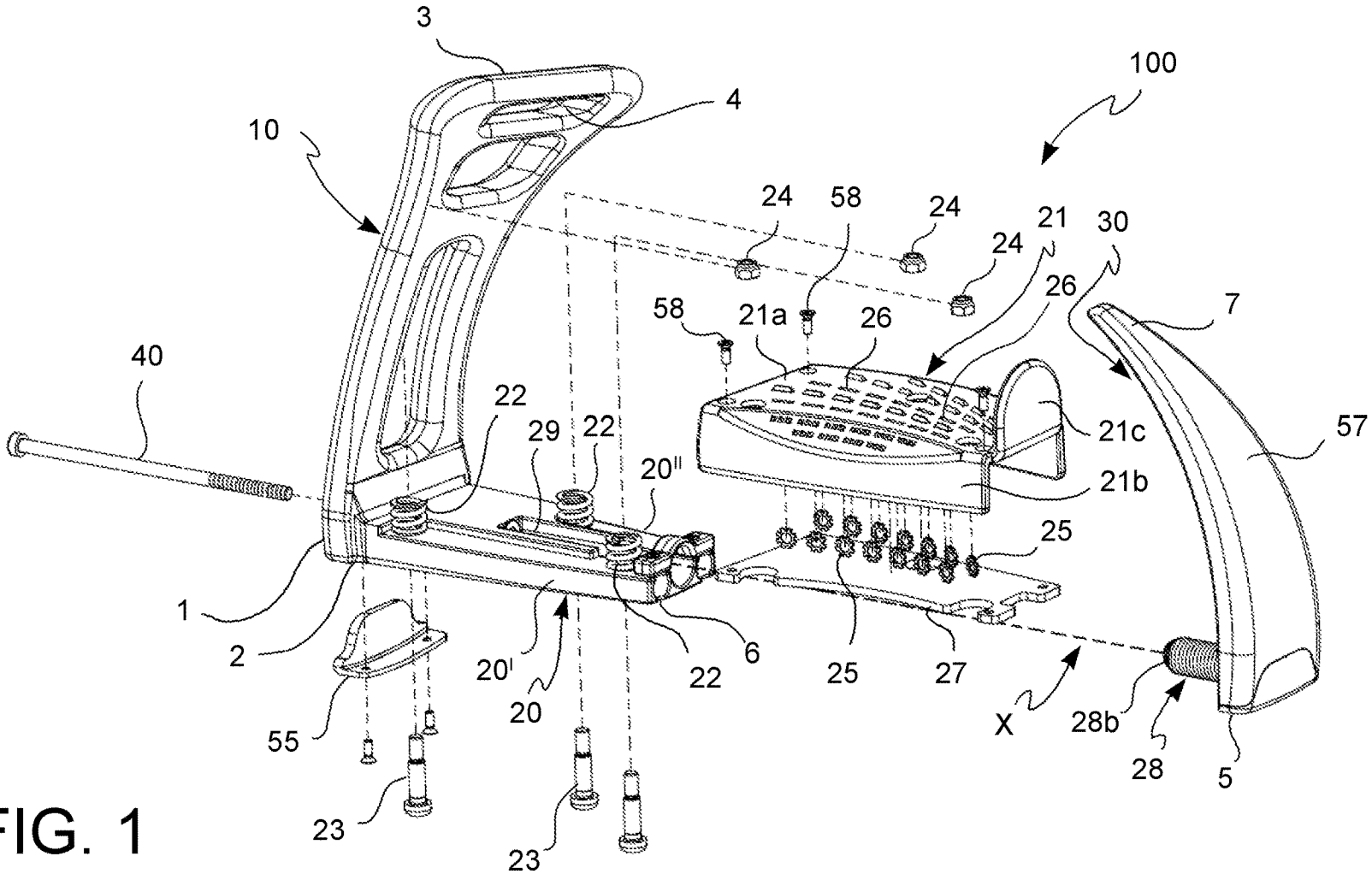
FIG. 1 shows a first perspective exploded view of an embodiment of the stirrup for horseback riding disciplines of the invention.
Figure 2:
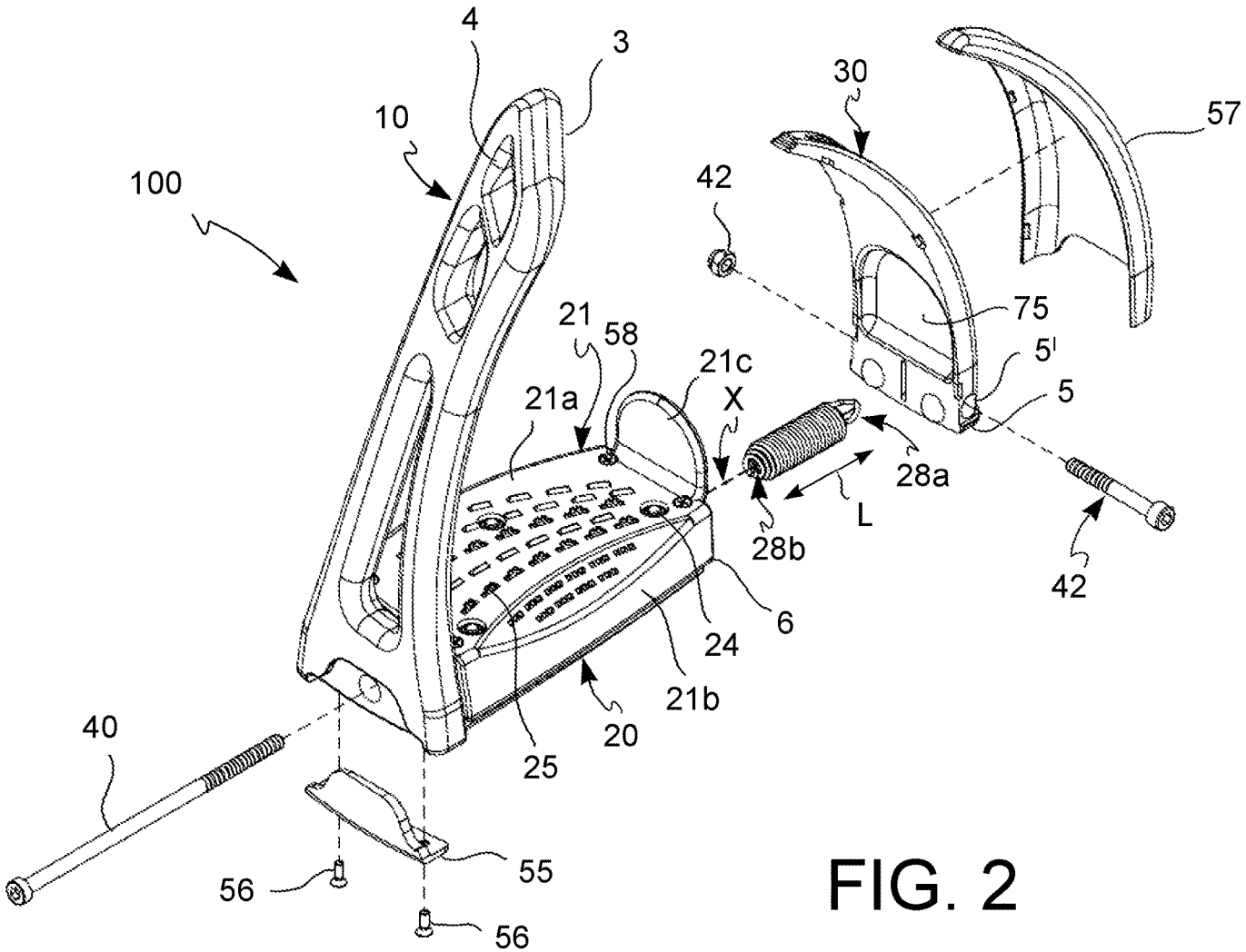
FIG. 2 shows a second perspective, partially exploded view of the stirrup for horseback riding disciplines of the invention.

Referring to the aforesaid FIGS. 1-10, a stirrup for horseback riding disciplines, in particular a safety stirrup, in accordance with the invention is overall indicated with the reference numeral 100.

Such a safety stirrup for horseback riding 100 or simply stirrup comprises, in general, a first semi-arch element 10 having a first end 1 integrally connected to a first portion 2 of a base element 20 of the stirrup and a second end 3 comprising a through hole 4 for mounting a stirrup leather.

Furthermore, the stirrup 100 comprises second semi-arch element 30 having an end 5 elastically connected to a second portion 6 of the base element 20 opposed to the first portion 2. Such a second semi-arch element 30 is configured to delimit, by the first semi-arch element 10 and the base element 20, a portion for inserting a rider's foot into the stirrup.

Referring to the embodiment in the figures, the second end 3 of the first semi-arch element 10 is free. Furthermore, the second semi-arch element 30 has a respective end or further free end 7 separate from the first semi-arch element 10. In other words, the second free end 3 of the first semi-arch element 10 is free from contact with the second semi-arch element 30. The further free end 7 of the second semi-arch element 30 is free from contact with the first semi-arch element 10.

In an embodiment, the stirrup 100 comprises a support platform for the rider's foot or tread 21 associated with the base element 20 of the stirrup. Such a support platform 21 is removably attached to the base element 20.

Such a platform 21 comprises a base portion 21*a* integrally connected to two lateral portions 21*b* orthogonal to the base portion. Thereby, the platform 21 of the stirrup 100 has a substantially U-shaped cross section.

Furthermore, the platform 21 comprises a rib 21*c* integrally connected and orthogonal to the base portion 21*a*. In particular, such a rib 21*c* extends from the base portion 21*a* of the platform 21 in a direction opposite to the above-mentioned lateral portions 21*b*. Such a rib 21*c* is configured to be accommodated in a respective recess 75 obtained in the second semi-arch element 30 of the stirrup 100.

Figure 9:
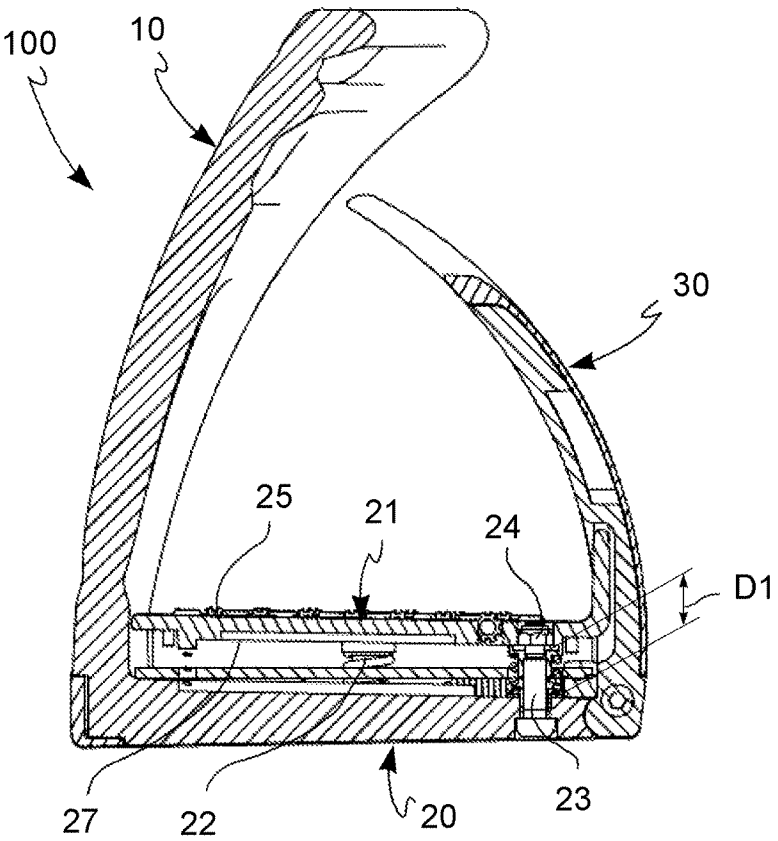

In another embodiment, referring to FIGS. 1 and 9, the stirrup 100 comprises elastic means 22 interposed between the platform 21 and the base element 20 configured to define a first distance D1 between the platform 21 itself and the base element 20 in an initial rest condition.

Furthermore, the stirrup 100 comprises adjustment means 23, 24 acting on elastic means 22 for changing the first distance D1 from the initial rest condition to a second rest condition. In such a second rest condition, the elastic means define a second distance between the platform 21 and the base element 20 of the stirrup different from the aforesaid first distance D1.

In more detail, such elastic means interposed between the platform 21 and the base element 20 of the stirrup 100 comprise at least one compression spring 22, of the coil type, and the adjustment means comprise at least one screw 23 inserted into and coaxial to the aforesaid at least one compression spring 22. Such a screw 23 is configured to cooperate with at least one nut 24 screwable on/unscrewable from the aforesaid screw to compress/decompress the compression spring 22.

In particular, in the example in FIG. 1, the stirrup 100 comprises three compression springs 22, three screws 23 and three nuts 24. Two compression springs 22 of this type are placed next to a first edge 20' of the base element 20 and another is next to a second edge 20" of the base element 20 opposite to the first edge. Thereby, the compression springs 22 are placed at the corners of a triangle and each is associated with a respective screw 23 and nut 24.

With the stirrup 100 of the invention, it is therefore possible to adapt the cushioned platform 21 to the pressure level exertable by the rider's foot. Such an adaptation is effected by manually adjusting, acting on the screw 23 and the nut 24, the compression level of one or more of the compression springs 22 holding the support platform 21. In other words, the cushioned platform 21 of the stirrup 100 may be calibrated on the weight of the rider to reduce the impact stress on the rider's joints during the performance of the sporting activity.

Furthermore, the arrangement of the aforesaid compression springs 22 at the corners of a triangle advantageously allows the platform 21 to oscillate or tilt about a main extension axis X of the base element 20, increasing the comfort of the rider's foot inserted into the stirrup 100.

In another embodiment, the stirrup for horseback riding 100 further comprises a plurality of removable friction elements 25 associated with the platform 21. In particular, such a plurality of removable friction elements comprises washers 25 partially protruding from respective through seats 26 provided in such a platform 21. In more detail, such washers 25 are interposed between the platform 21 and a mounting wall 27 removably attached to the base element 20 of the stirrup 100.

In other words, by changing the number, arrangement and type of washers 25 on the platform 21, it is possible to increase the grip of the rider's footwear to the stirrup platform 21 so as to adapt it to the physical and sporting needs of different riders.

Figure 4:
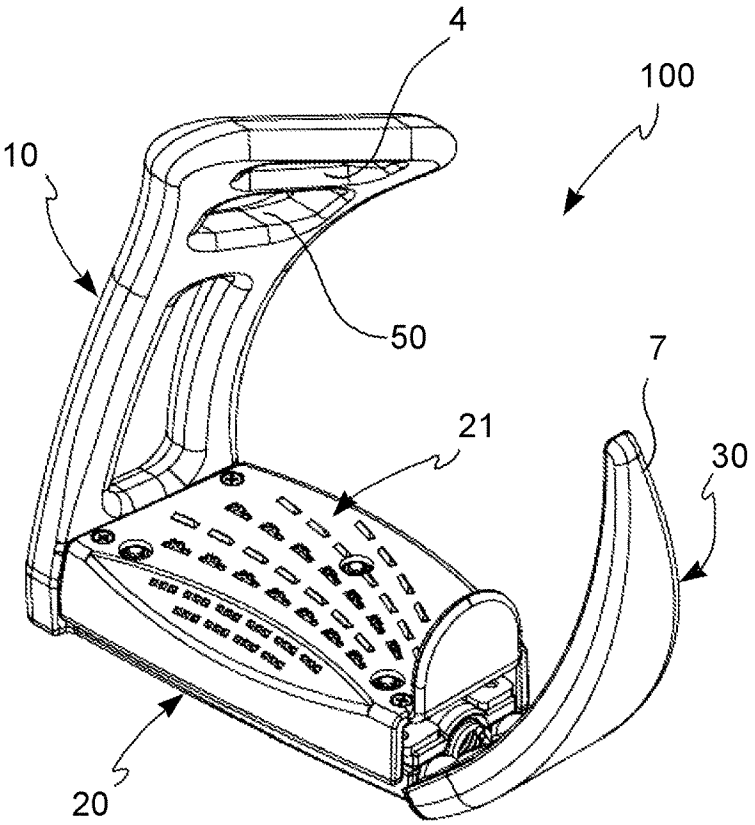
FIG. 4 shows a perspective view of the stirrup in FIG. 1 with the second semi-arch element in position partially bent away from the first semi-arch element.
Figure 3:
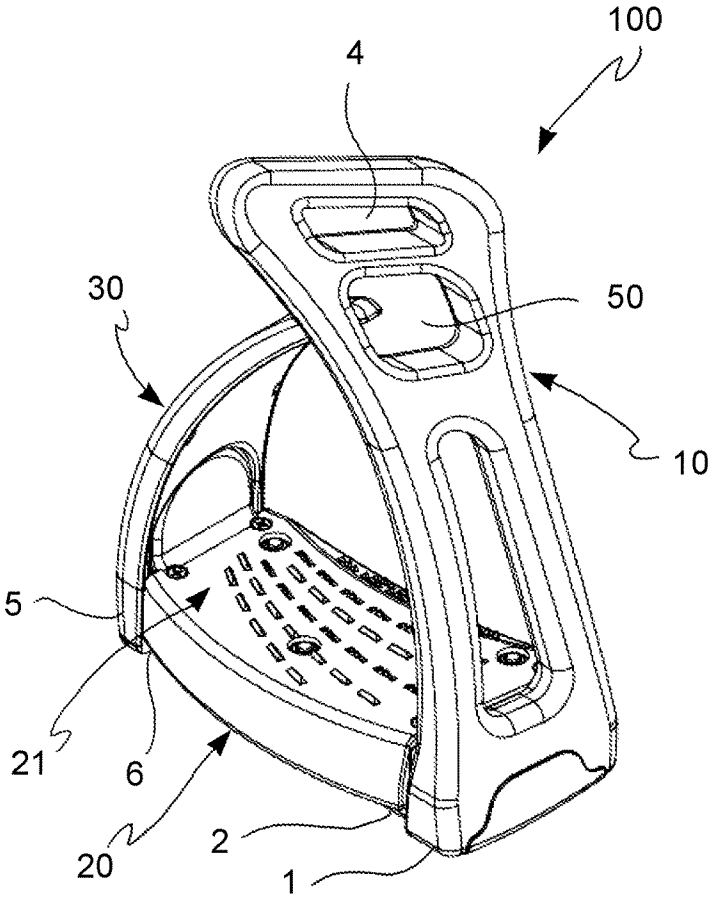
FIG. 3 shows a perspective view of the stirrup for horseback riding in FIGS. 1 and 2 in assembled configuration including a first and a second semi-arch element separate from each other.
Figure 5:
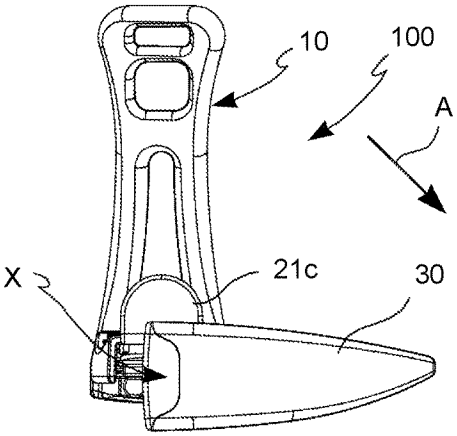
FIGS. 5 and 6 show a left side view and a front view of the stirrup in FIG. 4 in which, facing the first semi-arch element, the second semi-arch element is bent by 90° clockwise with respect to a use position of the stirrup.
Figure 6:
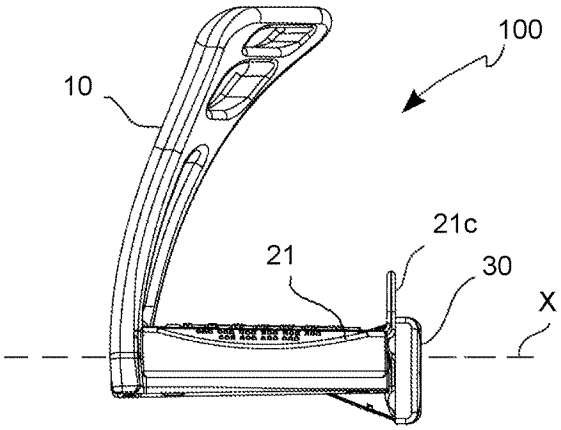
Figure 7:
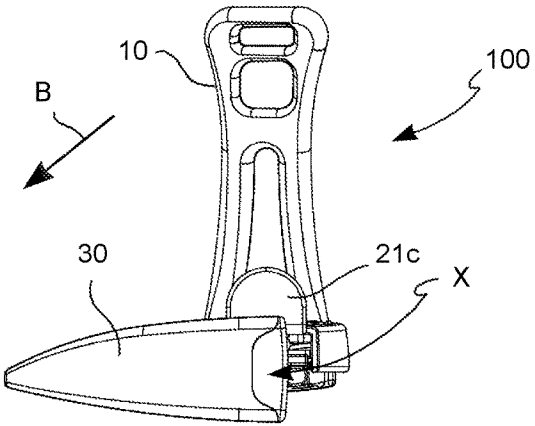
FIGS. 7 and 8 show a left side view and a front view of the stirrup in FIG. 4 in which, facing the first semi-arch element, the second semi-arch element is bent by 90° counter clockwise with respect to a use position of the stirrup.
Figure 8:
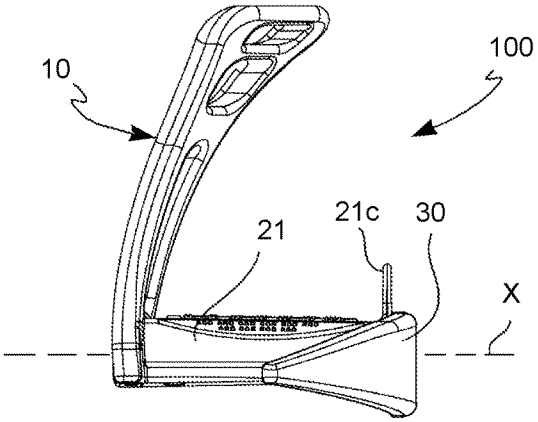

In accordance with a preferred and more general embodiment of the invention, the stirrup for horseback riding 100 of the invention further comprises first elastic means 28 interposed between the end 5 of the second semi-arch element 30 and the second portion 6 of the base element 20. Such first elastic means 28 have an extension direction parallel to the main axis X of the base element 20 to allow the bending of the second semi-arch element 30 along such a main axis X away from the first semi-arch element 10 as shown in FIG. 4. Such a bending is effected, for example, as a result of the application of a force by the rider's foot on the second semi-arch element 30 towards the outside of the stirrup 100. Such a second semi-arch element elastically returns to a rest position as a result of the ceasing of such a force.

In more detail, the first elastic means comprise an extension coil spring 28 housed in a compartment 29 provided in the base element 20. Such an extension coil spring 28 has a coupling portion 28*a* attached to the end 5 of the second semi-arch element 30 and an opposite tapered portion 28*b* configured to engage with first adjustment means 40, 41 rotatable for changing a length L of such an extension spring 28.

It should be noted that the compartment 29 provided in the base element 20 has a first length greater than the length L of the extension spring 28. Furthermore, referring to FIG. 2, the coupling portion 28*a* of the spring 28 is connected to a bolt element 42 accommodated in a transverse through hole 5' provided in the end 5 of the second semi-arch element 30.

Figure 10:
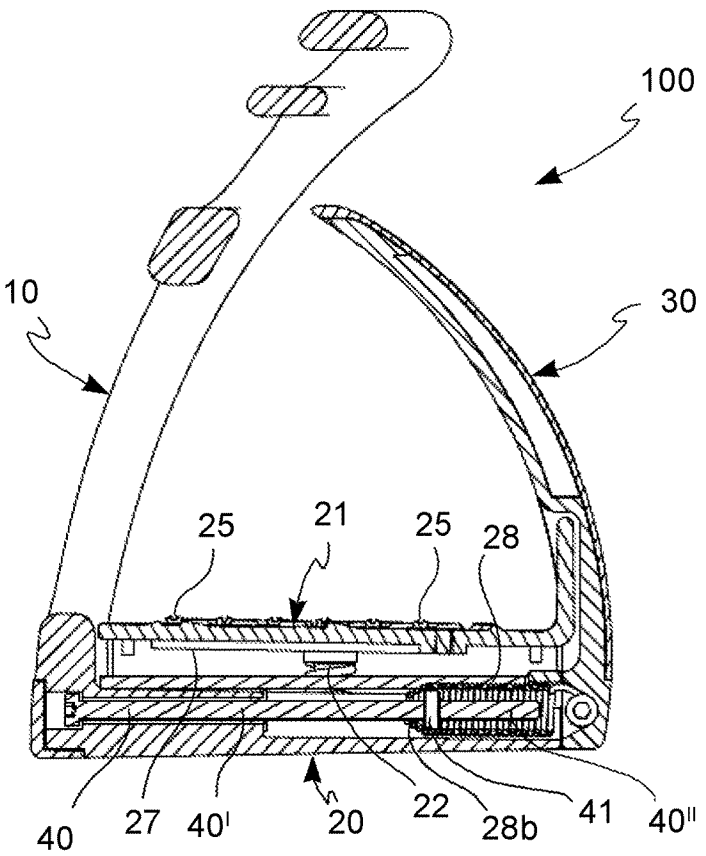
FIGS. 9 and 10 show longitudinal sectional views of the stirrup in FIG. 3.

In particular, the aforesaid first rotatable adjustment means comprise a threaded adjustment pin 40 coaxial to the extension spring 28 and insertable into such a tapered portion 28*b* of the extension spring. Referring to FIG. 10, such an adjustment pin 40 includes an outer pin portion 40' to the extension spring 28 and an internal pin portion 40" to the extension spring.

The first adjustment means further comprise, a respective nut 41 screwed on the adjustment pin portion 40" internal to the extension spring 28 and configured to abut against the tapered portion 28*b* of the extension spring itself to oppose a free sliding of such a tapered portion 28*b* towards the opposite coupling portion 28*a* of the spring 28 at the end 5 of the second semi-arch element 30.

In accordance with the present invention, the extension spring 28 parallel to base element 20 allows to bend the second semi-arch element or safety arch 30 along the direction of the axis X, ensuring that the same elastically returns to the initial position at the end of the movement.

The yielding of the second semi-arch element 30 may be calibrated on the weight of the rider by acting on the extension spring 28. In particular, such a calibration is obtainable, for example, in two equivalent manners. A first manner provides for acting directly from the outside of the stirrup 100, intervening on the head of the threaded adjustment pin 40 of the extension spring 28, for example by screwing or unscrewing such a pin. In detail, the head of the threaded pin 40 is accessed by removing a cover element 55 attached to the base element 20 with screws 56.

A second manner provides for removing the platform 21 of the stirrup 100, by unscrewing the respective screws 58, to replace the extension spring 28.

It should be noted that, advantageously, the presence of the rib 21*c* of the platform 21, engaged in the recess 75 of the second semi-arch element 30 in a rest or normal use position of the stirrup, gives greater rigidity and inertia to such a semi-arch element 30 and defines a rider's foot support surface separate from the second bendable semi-arch element. Thereby, the rib 21*c* allows to prevent undesired bendings of the second semi-arch element 30 along the direction of the axis X during the normal performance of the horseback riding activity and ensures greater comfort in the support of the rider's foot on the platform 21.

Referring to FIGS. 5, 6, 7 and 8 from the rest or normal use position of the stirrup 100, the second semi-arch element 30, released from the rib 21*c* of the platform 21, is rotatable about the direction of the axis X both clockwise (direction indicated by the first arrow A) and counter clockwise (direction indicated by the second arrow B).

In particular, from the normal use position of the stirrup 100, the second semi-arch element 30 is rotatable both in the direction indicated by the first arrow A and in that indicated by the second one B, to take a plurality of intermediate positions between the normal use position of the stirrup 100 and respective first and second end stop positions. Such first and second end stop positions are placed at angles of ±90° from such a normal use position (corresponding to an angle of 0°). In other words, such first and second end stop positions are opposed each other and placed at angles of 90° from such a rest position.

It should be noted that the rotation of the second semi-arch element 30 in the direction of the arrows A and B may be caused, for example, by the rider's foot movement when falling. Thereby, advantageously, the safety stirrup 100 of the invention is configured to allow an eased disengagement of the rider's foot in the event of falling as compared to the known stirrups.

The opposite rotation of the second semi-arch element 30 from the end stop positions or one of the intermediate positions mentioned above towards the normal use position of the stirrup 100 may be performed manually.

In an embodiment, the second semi-arch element 30 of the stirrup 100 comprises a shell or cover 57, for example snap attached, in a removable manner, to the second semi-arch element 30. Such a cover 57 allows the rider to aesthetically customize the safety arch 30 of the stirrup 100 by choosing both the material and the pattern of the cover 57.

In particular, the shell 57 is, for example, manufactured in a material selected from the group consisting of:

metal materials, including pure metals or alloys;

carbon fiber;

polymeric materials;

glass fiber.

In addition to the advantages in terms of customization of the stirrup 100, an advantage offered by the removable attachment of the shell or cover 57 to the stirrup is the ability to replace the damaged or otherwise worn shells with new shells in order to restore the original aesthetic appearance of the stirrup or to modify it and embellish it. For example, it is possible to apply a cover 57 reproducing the colors of the flags of nations represented in an international horse racing contest.

In an embodiment, the first semi-arch element 10 has an inclination with respect to a plane parallel to the base element 20 of the stirrup 100 of between 40° and 50°, preferably an inclination of 45°. Such an inclination offers the advantage, once mounted on a horse, of allowing to ease the retrieval of the stirrup in the event of involuntary disengagement of the foot from the stirrup itself.

In another embodiment, the first semi-arch element 10 of the stirrup of the invention 100 comprises a first through hole 50 for inserting a bent portion of the stirrup leather. Such a bent portion of the stirrup leather may slide in the first through hole 50 to reduce a distance of the stirrup 100 from the saddle from an initial use condition to a second use condition of the stirrup. In particular, in such a second use condition, the stirrup 100 is placed in the high position of the stirrup leather corresponding to a work position without rider. The rider may quickly return the stirrup to the initial use condition, i.e. in the low position of the stirrup leather, corresponding to a work position with rider, by simply pulling the stirrup 100 until disengaging the bent portion of the stirrup leather from the first through hole 50.

In a different embodiment of the stirrup of the invention (not shown in the Figures), such a stirrup comprises further first elastic means interposed between the end of the second semi-arch element and the second portion of the base element, in which such first elastic means have an extension direction orthogonal to a plane parallel to the base element. Such first elastic means, which become effective in a respective extension coil spring, allow the bending of the second semi-arch element both along the direction of the main extension axis X of the base element and along the directions Y, Z orthogonal to the aforesaid main direction away from the first semi-arch element.

In a preferred embodiment of the invention (not shown in the Figures), the stirrup 100 comprises the second bendable semi-arch element 30 associated with the extension spring 28 parallel to the base element 20 and all the structural and functional features connected thereto as described above, including the rib 21*c* of the platform 21 housable in the recess 75. Such a stirrup comprises neither the elastic means 22 interposed between the platform 21 and the base element 20, nor the removable friction elements 25 associated with the platform 21 itself.

In another embodiment of the invention (not shown in the Figures), the stirrup 100 only comprises the elastic means 22 interposed between the platform 21 and the base element 20 with respective adjustment means 23, 24 and with all the structural and functional features of the stirrup connected thereto and described above. In such an embodiment, the stirrup comprises neither the removable friction elements 25 associated with the platform 21 nor the second bendable semi-arch element 30. In other words, the second semi-arch element 30 comprises the end 5 integrally connected to the second portion 6 of the base element 20.

In another different embodiment of the invention (not shown in the Figures), the stirrup 100 only comprises the removable friction elements 25 associated with the platform 21 and with all the structural and functional features of the stirrup connected thereto and described above. In such an embodiment, the stirrup comprises neither elastic means 22, interposed between the platform 21 and the base element 20, nor the second bendable semi-arch element 30.

As indicated above, the safety stirrup 100 for horseback riding of the present invention has many advantages and achieves the intended objects.

In particular, such a stirrup 100 allows the rider to calibrate the force with which the semi-arch-safety arch 30 is bent. Such a property, together with the possibility offered by the second semi-arch element 30 to rotate about the main axis X, for example as a result of the abrupt movement of the rider's foot when falling, allows an easier disengagement of the rider's foot in the event of falling than the known stirrups, and achieves an undoubted improvement in terms of safety of the stirrup of the invention. Moreover, the extension spring 28 may be calibrated according to the weight of the rider (for example, a child, a woman and a man).

Furthermore, such a stirrup 100 allows to adjust the pressure level exertable by the rider's foot on the platform 21, i.e. the cushioned platform may be calibrated on the weight of the rider to reduce the impact stress on the rider's joints during the performance of the sporting activity. In other words, the stirrup 100 increases the comfort of the rider during the performance of the horseback riding activity.

Furthermore, the stirrup 100 of the invention improves the safety degree offered by increasing the grip or adherence of the rider's sporting footwear to the platform 21 so as to adapt it to the physical and sporting needs of different riders.

Those skilled in the field, in order to satisfy contingent needs, may modify and adapt the embodiments of the stirrup for horseback riding of the invention, and replace elements with other functionally equivalent, without departing from the scope of the following claims. Each of the features described as belonging to a possible embodiment may be achieved irrespective of the other embodiments described.

The invention claimed is:

1. A safety stirrup for horseback riding comprising:

a first semi-arch element having a first end integrally connected to a first portion of a base element of the stirrup and a second end comprising a through hole for mounting a stirrup leather;

a second semi-arch element having an end elastically connected to a second portion of the base element opposed to the first portion, said second semi-arch element being configured to delimit, by said first semi-arch element and said base element, a portion for inserting a rider's foot in the stirrup;

the safety stirrup further comprises a first elastic interposed between the end of the second semi-arch element and the second portion of the base element, said first elastic having an extension direction parallel to a main axis (X) of the base element to allow the bending of the second semi-arch element along said main axis (X) away from the first semi-arch element as a result of the application of a force on the second semi-arch element in such a moving away direction and to elastically return said second semi-arch element to a rest position when said force ends.

2. The safety stirrup for horseback riding of claim 1, wherein said first elastic comprises an extension coil spring housed in a compartment provided in the base element.

3. The safety stirrup for horseback riding of claim 2, wherein said extension coil spring has a coupling portion attached to the end of the second semi-arch element and an opposite tapered portion configured to engage with a first rotatable adjustment for changing a length (L) of said extension spring.

4. The safety stirrup for horseback riding of claim 3, wherein said first rotatable adjustment means comprises:

a threaded adjustment pin coaxial to the extension coil spring and insertable in said tapered portion of the extension spring, said adjustment pin including a pin portion external to the extension spring and a pin portion internal to the extension spring;

a nut screwed on said adjustment pin portion internal to the extension spring configured to abut against said tapered portion of the extension spring to oppose a free sliding of the tapered portion towards the opposite coupling portion of the extension spring at the end of the second semi-arch element.

5. The safety stirrup for horseback riding of claim 1, wherein said second semi-arch element is rotatable about said main axis (X) clockwise and counterclockwise starting from the rest position of the stirrup, to take a plurality of intermediate positions between said rest position of the stirrup and respective first and second end stop positions.

6. The safety stirrup for horseback riding of claim 5, wherein said first and second end stop positions are opposed to each other and placed at angles of 90° from such a rest position.

7. The safety stirrup for horseback riding of claim 1, wherein said second end of the first semi-arch element is a free end and said second semi-arch element comprises a further free end separate from the first semi-arch element.

8. The safety stirrup for horseback riding of claim 1, further comprising a support platform for the rider's foot removably fastened to said base element of the stirrup.

9. The safety stirrup for horseback riding of claim 8, wherein said support platform comprises:

a base portion integrally connected to two lateral portions orthogonal to the base portion;

a rib integrally connected and orthogonal to the base portion, such a rib extending from the base portion of the support platform in a direction opposite to said lateral portions, said rib being configured to be accommodated in a recess of the second semi-arch element.

10. The safety stirrup for horseback riding of claim 1, wherein said first semi-arch element has an inclination with respect to a plane parallel to the base element of the stirrup from 40° to 50°, or an inclination of 45° with respect to a plane parallel to the base element of the stirrup.

11. The safety stirrup for horseback riding of claim 1, wherein said first semi-arch element further comprises a first through hole for inserting a bent portion of the stirrup leather, said bent portion of the stirrup leather sliding in said first through hole (50) to reduce a distance of the stirrup from a saddle from a first use condition to a second use condition of the stirrup.

12. The safety stirrup for horseback riding of claim 1, further comprising a shell or cover removably attached to the second semi-arch element to aesthetically customize said second semi-arch element, said shell being manufactured in a material selected from the group consisting of:

metal materials, including pure metals or alloys;

carbon fiber;

polymeric materials;

glass fiber.

* * * * *